US007597939B2

(12) United States Patent
Hennessey

(10) Patent No.: US 7,597,939 B2
(45) Date of Patent: Oct. 6, 2009

(54) PROCESS FOR APPLYING FLUOROPOLYMER POWDER COATING AS A PRIMER LAYER AND AN OVERCOAT

(75) Inventor: Craig King Hennessey, Avondale, PA (US)

(73) Assignee: E.I. du Pont de Nemours and Company, Wilmington, DE (US)

( * ) Notice: Subject to any disclaimer, the term of this patent is extended or adjusted under 35 U.S.C. 154(b) by 265 days.

(21) Appl. No.: 11/701,076

(22) Filed: Feb. 1, 2007

(65) Prior Publication Data

US 2008/0187667 A1 Aug. 7, 2008

(51) Int. Cl.
*B05D 1/06* (2006.01)
*B05D 1/12* (2006.01)

(52) U.S. Cl. ..... 427/470; 427/202

(58) Field of Classification Search ..... None
See application file for complete search history.

(56) References Cited

U.S. PATENT DOCUMENTS

| | | | | |
|---|---|---|---|---|
| 3,065,205 | A | | 11/1962 | Bonner, Jr. |
| 3,441,538 | A | | 4/1969 | Marks |
| 3,442,657 | A | | 5/1969 | Thornton |
| 4,380,618 | A | | 4/1983 | Khan et al. |
| 4,578,427 | A | | 3/1986 | Saito et al. |
| 5,093,403 | A | | 3/1992 | Rau et al. |
| 5,131,827 | A | | 7/1992 | Tasaka |
| 5,240,775 | A | * | 8/1993 | Tannenbaum ..... 428/422 |
| 5,357,040 | A | | 10/1994 | McGrath et al. |
| 5,922,468 | A | * | 7/1999 | Huesmann et al. ..... 428/422 |
| 6,232,372 | B1 | | 5/2001 | Brothers et al. |
| 6,518,349 | B1 | | 2/2003 | Felix et al. |
| 2002/0150778 | A1 | * | 10/2002 | Leech et al. ..... 428/474.4 |
| 2003/0207057 | A1 | | 11/2003 | Britto et al. |
| 2004/0253387 | A1 | | 12/2004 | Cavero |
| 2006/0110601 | A1 | | 5/2006 | Hennessey |

FOREIGN PATENT DOCUMENTS

| | | | |
|---|---|---|---|
| WO | WO 99/47615 | | 9/1999 |
| WO | WO 2004/0243348 | A1 | 3/2004 |
| WO | WO 2006/055923 | A1 | 5/2006 |
| WO | WO 2006/121940 | A1 | 11/2006 |

OTHER PUBLICATIONS

PCT International Search Report and Written Opinion for International Application No. PCT/US2008/001290 dated Aug. 6, 2008.

* cited by examiner

*Primary Examiner*—Frederick J Parker

(57) ABSTRACT

A process for forming a release surface on a substrate includes applying a primer powder on the substrate to form a primer layer, applying an overcoat powder on the primer layer to form an overcoat layer, and baking the substrate after applying both the primer powder and the overcoat powder. The primer powder includes a tetrafluoroethylene/perfluoroolefin copolymer and a non-melt processible binder. The overcoat powder includes a tetrafluoroethylene/perfluoro (alkyl vinyl ether) copolymer.

20 Claims, No Drawings

PROCESS FOR APPLYING FLUOROPOLYMER POWDER COATING AS A PRIMER LAYER AND AN OVERCOAT

BACKGROUND INFORMATION

1. Field of the Disclosure

This invention is in the field of forming a durable release surface by applying a primer powder to a substrate to form a fluoropolymer primer layer thereon, and applying a fluoropolymer powder on the primer layer to form an overcoat. In particular, the invention is directed to the selection of a fluoropolymer primer powder that achieves good intercoat adhesion with a tetrafluoroethylene/perfluoro(alkyl vinyl ether) copolymer powder overcoat and maintains a long lasting bond with the substrate.

2. Background of the Related Art

Fluoropolymer resins having properties such as good chemical resistance, excellent release, good heat resistance and electrical insulation are desirable in a number of applications. Fluoropolymer powders which are melt-flowable have been found useful in coating cookware articles such as rice cookers, grills and bakeware, as well as numerous industrial applications such as fuser rolls or belts for copiers and printers, and chemical processing reactors. One of the advantages of applying powder coatings in lieu of liquid coatings is that the drying and venting steps used in applying liquid coatings, as well as the equipment associated with applying liquid coatings, are eliminated. In addition, powder coatings do not require the use of volatile organic solvents that present environmental concerns and necessitate expensive remediation procedures.

Powder coating, for both a primer layer and an overcoat, is described in U.S. Pat. No. 5,093,403 to Rau et al. In this patent, perfluoroalkoxy polymer (PFA) is exemplified for both the primer layer and the overcoat. This patent recognizes that it is difficult to bond PFA resin to metal substrates, and that PFA must be applied at relatively high temperatures—i.e., in the range of about 675° to about 720° F. (357° to 382° C.). Rau et al. discloses the use of binders such as poly (phenylene sulfide) (PPS) to achieve bonding of the PFA resin to the metal substrate at these elevated temperatures without any significant deterioration (degradation) to the PFA.

Because of its high service temperature, good abrasion resistance and excellent release properties, PFA is the resin of choice for surfaces used in rigorous commercial applications such as for release surfaces for commercial bakeware. Commercial bake pans undergo numerous high temperature cycles each day and must retain their release properties for a significant length of time to make commercial production of baked goods economical. However, experience has shown that the application of a PFA overcoat on a PFA primer layer results in inadequate adhesion of the system over time. As a result, a PFA/PFA system as disclosed in Rau et al. may fail too quickly and inadequately addresses the needs of a commercial operation that subjects substrates with release surfaces to thousands of bake cycles per year.

Thus, there remains a need for an improved primer powder composition that can be used with a PFA topcoat, and that will permit a primer/topcoat system that can be used at high service temperatures with improved adhesion and longer life while maintaining good release properties and abrasion resistance.

SUMMARY

It has been found that the use of a tetrafluoethylene/perfluoroolefin copolymer and a non-melt processible binder applied as a primer powder in conjunction with a powder overcoat of a tetrafluoroethylene/perfluoro(vinyl alkyl ether) copolymer, also known as perfluoroalkoxy polymer (PFA), when baked onto a substrate gives superior and more durable adhesion of the coating system to the substrate.

Briefly stated, and in accordance with one aspect of the present invention, there is provided a process for forming a release surface on a substrate includes applying a primer powder on the substrate to form a primer layer, applying an overcoat powder on the primer layer to form an overcoat layer, and baking the substrate after applying both the primer powder and the overcoat powder. The primer powder includes a tetrafluoroethylene/perfluoroolefin copolymer and a non-melt processible binder. The overcoat powder includes a tetrafluoroethylene/perfluoro(alkyl vinyl ether) copolymer.

The foregoing general description and the following detailed description are exemplary and explanatory only and are not restrictive of the invention, as defined in the appended claims.

DETAILED DESCRIPTION

In accordance with the present invention, there is provided a process for forming a release surface on a substrate including applying a primer powder on the substrate to form a primer layer, applying an overcoat powder on the primer layer to form an overcoat layer, and baking the substrate after applying both the primer powder and the overcoat powder. The primer powder includes a tetrafluoroethylene/perfluoroolefin copolymer and a non-melt processible binder. The overcoat powder includes a tetrafluoroethylene/perfluoro (alkyl vinyl ether) copolymer.

In one embodiment, the non-melt processible binder includes polyamideimide, polybenzimidazole, polyimide, a liquid crystal polymer, or any combination thereof. In a specific embodiment, the non-melt processible binder includes polyamideimide.

In still another embodiment, the primer powder includes 35 to 90 weight percent of the tetrafluoroethylene/perfluoroolefin copolymer and 10 to 65 weight percent of the non-melt processible binder, based on a combined weight of the tetrafluoroethylene/perfluoroolefin copolymer and the non-melt processible binder.

In one embodiment, the perfluoroolefin includes hexafluoropropylene. In another embodiment, the perfluoro(alkyl vinyl ether) includes perfluoro(propyl vinyl ether).

In yet another embodiment, the primer powder further includes a melt processible binder. In a more specific embodiment, the melt processible binder includes polyether sulfone, polyphenylene sulfide, polyaryleneetherketone, or any combination thereof. In another more specific embodiment, the primer powder includes 10 to 55 weight percent of the melt processible binder, based on a combined weight of the tetrafluoroethylene/perfluoroolefin copolymer, the non-melt processible binder, and the melt processible binder.

In one embodiment, the primer powder further includes an inorganic filler. In a more specific embodiment, the inorganic filler includes mica flake, silicon carbide, carbon black, barium sulfate, ultramarine blue, mixed metal oxide pigment, aluminum oxide, or any combination thereof. In another specific embodiment, the inorganic filler comprises mica flake and barium sulfate. In yet another more specific embodiment, the primer powder includes 10 to 20 weight percent of the inorganic filler based on a combined weight of the tetrafluoroethylene/perfluoroolefin copolymer, the non-melt processible binder, and the inorganic filler.

In one embodiment, applying the primer powder includes electrostatic spraying or hot flocking. In another embodiment, applying the overcoat powder includes electrostatic spraying or hot flocking.

In one embodiment, the substrate includes metal, ceramic, plastic, glass, or any combination thereof. In a more specific embodiment, the metal includes steel, high carbon steel, stainless steel, aluminized steel, aluminum, or any combination thereof.

In one embodiment, the substrate is at an ambient temperature when applying the primer powder, applying the overcoat powder, or both.

In another embodiment, the process further includes baking the substrate after applying the primer powder and before applying the overcoat powder.

In still another embodiment, a thickness of the primer layer is less than 100 micrometers and a thickness of the overcoat layer is less than 650 micrometers.

In still yet another embodiment, a release coating on a substrate is formed by the process.

U.S. Patent Application Publication No. 2006/0110601 to Hennessey describes the use of powder coatings for both a primer layer and a topcoat, wherein the primer layer includes a tetrafluoroethylene/perfluoroolefin copolymer and the overcoat includes a tetrafluoroethylene/perfluoro(vinyl alkyl ether) copolymer. The primer powders of Hennessey further include melt processible polymer binders that aid in the formation of strong, durable coatings. Surprisingly, it has been found that the use of a non-melt processible binder in a similar system can provide a coating system with excellent adhesion properties, with, or without, the use of a melt processible binder in the powder primer.

Many aspects and embodiments have been described above and are merely exemplary and not limiting. After reading this specification, skilled artisans appreciate that other aspects and embodiments are possible without departing from the scope of the invention. Other features and advantages of the invention will be apparent from the following detailed description, and from the claims.

Fluoropolymers

The fluoropolymers used both in the primer and in the overcoat are melt-flowable. Typically, the melt viscosities will range from $10^2$ Pa·s to about $10^6$ Pa·s. In one embodiment, melt viscosities range from about $10^3$ to about $10^5$ Pa·s measured at 372° C. by the method of ASTM D-1238 modified as described in U.S. Pat. No. 4,380,618, and ASTM D-2116 or D-3307 depending on the copolymer. Examples of such melt-flowable fluoropolymers include copolymers of tetrafluoroethylene (TFE) and at least one fluorinated copolymerizable monomer (comonomer) present in the polymer in sufficient amount to reduce the melting point of the copolymer substantially below that of TFE homopolymer, polytetrafluoroethylene (PTFE), e.g., to a melting temperature no greater than 315° C.

The primer powder comprises a copolymer of tetrafluoroethylene (TFE) and perfluoroolefin. In one embodiment, the perfluoroolefin comonomer may have 3 to 8 carbon atoms, such as hexafluoropropylene (HFP). In one embodiment, the primer powder further comprises up to 60 weight percent of a copolymer of tetrafluoroethylene and perfluoro(alkyl vinyl ether) (PAVE) in which the linear or branched alkyl group contains 1 to 5 carbon atoms.

The overcoat powder comprises a copolymer of tetrafluoroethylene and perfluoro(alkyl vinyl ether) (PAVE) in which the linear or branched alkyl group contains 1 to 5 carbon atoms. In one embodiment, PAVE monomers are those in which the alkyl group contains 1, 2, 3 or 4 carbon atoms, and the copolymer can be made using several PAVE monomers. In one embodiment, TFE copolymers include PFA (TFE/PAVE copolymer), TFE/HFP/PAVE wherein PAVE is PEVE and/or PPVE and MFA (TFE/PMVE/PAVE wherein the alkyl group of PAVE has at least two carbon atoms).

The melting points of TFE/perfluoroolefin copolymers in the primer are typically below those of the TFE/PAVE copolymers of the overcoat powder. For instance the melting point of TFE/HFP, also known as FEP, is typically about 510° F. (266° C.) and below the melting point of TFE/PPVE which is typically about 590° F. (310° C.). Thus, it is surprising that the primer layer containing a lower melting point TFE/perfluoroolefin copolymer forms a superior and durable coating system with a higher melting TFE/PAVE (PFA) copolymer overcoat. One might have expected that a primer system with a lower melting fluoropolymer could not withstand high curing or baking temperatures, typically 675° F. (357° C.) to 720° F. (382° C.), used with PFA systems and that the lower melting copolymer would degrade (bubble) and cause delamination from the substrate. Surprisingly it has been found that the TFE/perfluoroolefin primer powder layer in conjunction with the PFA powder overcoat forms a coating system that when baked is superior in adhesion to PFA primer/PFA overcoat systems of the prior art.

Non-Melt Processible Binder

The primer powder coating used in the present invention further contains in addition to the tetrafluoroethylene/perfluoroolefin copolymer, a high temperature resistant non-melt processible binder. The primer powder may contain 35 to 90 weight percent of the non-melt processible binder based on the combined weight of the fluoropolymer(s) and the non-melt processible binder. A binder is well known for use in nonstick finishes for adhering fluoropolymer to substrates and for film-forming. The binder is generally non-fluorine containing and yet adheres to the fluoropolymer. Non-melt processible binders do not exhibit melt-flow behavior and do not have good film-forming properties when used alone. Non-melt processible binders include polyimide (PI), polybenzimidazole (PBI), polyamideimide (PAI) and liquid crystal polymers (LCPs). All of these non-melt processible binders can have a sustained service temperature in excess of 250° C.

Melt Processible Binder

The primer powder coating may further contain, in addition to the tetrafluoroethylene/perfluoroolefin copolymer and non-melt processible binder, a melt processible binder. The melt processible binder component comprises a polymer that is film-forming upon heating to fusion, is thermally stable, and has a high sustained temperature use. Melt processible binders include one or more: (1) polyethersulfones (PES), which are amorphous thermoplastic polymers with a glass transition temperature of about 230° C. and a sustained temperature service of about 170° C. to 190° C., (2) polyphenylene sulfides (PPS), which are partially crystalline polymers with a melting temperature of about 280° C. and a sustained temperature service of about 200° C. to 240° C., and (3) polyaryleneetherketone, such as polyetherketoneketone (PEKK), polyetheretherketone (PEEK), and polyetherketone (PEK) Polyaryleneetherketone are thermally stable at least 250° C. and melt at temperatures of at least 300° C. and are disclosed in one or more of the following U.S. Pat. Nos. 3,065,205, 3,441,538, 3,442,857, 5,357,040, 5,131,827, 4,578,427. All of the polymer binders listed above are thermally stable and dimensionally stable at temperatures within their sustained service range and below, and they are wear resistant. These polymers also adhere well to clean metal surfaces.

Other Additives

In addition to the fluoropolymer and binder, the primer powder and overcoat powder may contain inorganic fillers, film hardeners, pigments, stabilizers and other additives. Examples of suitable fillers and film hardeners include inorganic oxides, nitrides, borides and carbides of silicon, zirconium, tantalum, titanium, tungsten, boron, and aluminum as well as glass flake, glass bead, glass fiber, aluminum or zirconium silicate, mica, metal flake, metal fiber, fine ceramic powders, silicon dioxide, titanium dioxide, barium sulfate, talc, carbon black, etc. and synthetic fibers of polyamides, polyesters, and polyimides. In one embodiment, the primer powder contains 10 to 20 weight percent of inorganic filler based on the combined weight of the fluoropolymer(s), binder, and filler.

Primer Powder Preparation

The primer powder containing tetrafluoroethylene/perfluoroolefin copolymer and non-melt processible binder, and optionally other fluoropolymers, melt processible binders, and other additives as discussed above, may be made using conventional mechanical methods of blending powders of individual components.

Alternatively, multicomponent particles of primer powder i.e., tetrafluoroethylene/perfluoroolefin copolymer and binder with optionally other fluropolymer, can be made according to the teaching of Brothers et al. U.S. Pat. No. 6,232,372 by combining fluoropolymer particles and other components with a solution of binder, mixing the fluoropolymer with the solution of binder and isolating a composition of multicomponent particles of the fluoropolymer with non-dispersed binder. By "non-dispersed binder" is meant that the multicomponent relationship of the particles of the primer powder is not one in which the binder component is dispersed in the fluoropolymer component. Thus, the binder component used in one embodiment is not in the form of filler dispersed in fluoropolymer component, but rather exists as a coating surrounding the fluorpolymer particles. Non-dispersed binder being present at the surface of the multicomponent particles of this embodiment promotes adherence of the particles to a substrate when the composition is used as a primer coating.

In one embodiment, the primer powder can be made into a sprayable powder according to the teachings of Felix et al. in U.S. Pat. No. 6,518,349 by spray drying a liquid dispersion of primary particles of tetrafluoroethylene/perfluoroolefin copolymer together with binder, and optionally, other components as discussed above, to produce friable granules of agglomerated particles of tetrafluoroethylene/perfluoroolefin copolymer and binder. By "friable" is meant that the granules can be reduced to a smaller particle size (comminuted) without causing appreciable particle deformation such as the formation of fibrils extending from the ground particles. Blends of polymers and components formed by the spray dried method are more uniform than those formed by conventional mechanical methods of blending powders of individual components after powder formation.

Multicomponent powders formed by spray drying do not segregate during electrostatic application thereby providing more uniform coatings on substrates.

The fluoropolymer component used in spray drying is generally commercially available as a dispersion of the polymer in water, which may offer ease of application and environmental acceptability. By "dispersion" is meant that the fluoropolymer particles are stably dispersed in the aqueous medium, so that settling of the particles does not occur within the time when the dispersion will be used; this is achieved by the small size of the fluoropolymer particles (also referred to as primary particles), typically on the order of 0.2 micrometers, and the use of surfactant in the aqueous dispersion by the dispersion manufacturer. Such dispersions can be obtained directly by the process known as dispersion polymerization, optionally followed by concentration and/or further addition of surfactant.

Application of the Powders

The primer powder and overcoat powder can be applied to substrates by suspending the dried powder in a suitable liquid with suitable surfactants or viscosity modifiers as desired and depositing the composition by a wet coating technique. In one embodiment, the powder coating is deposited in the dried form by well known conventional techniques, e.g., hot flocking, electrostatic spraying, electrostatic fluidized bed, rotolining and the like. In a more specific embodiment, electrostatic spraying, such as triboelectric spraying or corona spraying, is used.

Primer powders are typically applied to cleaned and degreased substrates which have been treated by conventional treatment such as grit blasting, etching, or chemical treatment, in order to aid adhesion of the coating to the substrate. While any suitable substrate can be coated, examples of typical metal substrates include steel, high carbon steel, stainless steel, aluminized steel and aluminum, among others. In one embodiment, the process of applying primer powder and overcoat primer to the substrate is performed when the substrate is at a temperature of 15 to 25° C. In addition to pretreatment of the substrate, formation of a strong, durable coating on a metal substrate is dependent on both the composition of the primer layer and the substrate. Good adhesion of the coating to the substrate is more easily achieved for aluminum substrates, is more difficult for high carbon steel substrates, and is most difficult for stainless steel substrates.

The powder overcoat may be applied to the substrate over the primer powder without first baking the primer powder in what is termed a single bake application, i.e., the baking of the overcoat typically bakes the primer layer. In the single bake system, the coated substrate is typically baked for 60 minutes at about 735° F. (390° C.) . Alternatively, the powder overcoat can be applied and baked after the primer layer is baked in what is referred to as a double bake application. Typically, the primer powder is applied to the substrate and baked at 725° F. (385° C.) for about 30 minutes with subsequent application of the overcoat powder which then baked for about another 30 minutes at 680° F. (360° C.). In typical applications, the primer layer is less than about 3 mils (75 micrometers) thick and the overcoat layer is no greater than about 25 mils (650 micrometers). In other applications, the primer layer is less than about 2 mils thick (50 micrometers); the overcoat layer is between about 1.5 to about 3 mils thick (38 micrometers to 76 micrometers).

Powder coatings as described above are used as the primer layer and the overcoat layer for the release surface on a substrate of the present invention. Such coatings have application to cookware and bakeware as well as to numerous industrial applications such as fuser rolls or belts for copiers and printers, valves, tanks, impellers, pipes, metal foil, shoe molds, snow shovels and plows, ship bottoms, chutes, conveyors, dies, tools, industrial containers, molds, lined reactor vessels, automotive panels, heat exchangers, tubing, and the like.

Test Method

Bond Strength Adhesion Test

Stainless steel 4.0"×12.0" (10.1 cm×30.5 cm) panels are cleaned with an acetone rinse. The panel has a grit blast surface. The panels are coated according to the description in each of the examples. The panels are subjected to a bond strength adhesion test as detailed below.

Bond strength of coated metal panels is determined by subjecting the coated substrate to a simplified T-peel test (Peel Resistance of Adhesives). The baked coating is cut through to the metal substrate with parallel lines one inch apart. A one inch wide chisel is used to pry up a flap of coating that is sufficient to hold on to. The coating is pulled from the substrate by hand, or alternatively with a pair of pliers.

Bond strength is rated before and after a boiling water test. For the boiling water test the panel is immersed in boiling water for a predetermined time. Bond failures are rated qualitatively with a rating system of 1 through 4 with a rating of 4 being the best adhesion rating. A rating of 1 is given to samples demonstrating an adhesive failure that resulted in the film peeling very easily. A rating of 2 is given to samples which exhibited an adhesive failure that required significant effort to peel the film. A rating of 3 is given to samples which failed by peeling, but resulted in significant elongation of the film or elongation of the film followed by gradual tearing of the film. A rating of 4 is given to samples which demonstrated a clean coating break or elongation followed by a break.

EXAMPLES

In the following Examples, stainless steel panel substrates approximately 8"×8"" are cleaned with acetone and grit blasted with 100 grit aluminum oxide) to a roughness of approximately 70-125 microinches Ra using Pro-Finish blast cabinet, Model PF-3648 available from Empire Abrasive Equipment Company.

Powder coatings are applied to the substrates using a Nordsen Sure-Coat electrostatic powder coating gun. Coated panels are baked in an electrically heated hot air convection oven with the times and temperatures specified in the examples. The ovens used for these examples are Class A solvent venting ovens.

For the examples where primer powder is prepared from tetrafluoroethylene/perfluoroolefin copolymer and binder by spray drying, the spray dryer used is a APV Pilot Spray Dryer type PSD52, manufactured by APV Anhydro AS, Copenhagen, Denmark. The spray dryer is operated with an inlet air temperature of 300° C. to 320° C. and an outlet temperature of 110° C. to 125° C. Powder is collected in a cyclone separator, fines are collected in a final filter and hot air and water vapor is exhausted. The dispersion is pumped using a peristalic pump and sprayed with a two fluid (air and liquid) nozzle. Air pressure on the nozzle is 60 psig.

Fluoropolymers

Unless otherwise stated in the following examples, dispersion concentrations are in weight percent based on the combined weights of solids and liquids. The solids contents of dispersions are determined gravimetrically and are stated in weight percent based on the combined weights of solids and liquids.

Melt flow rate (MFR) is measured at 372° C. by the method of ASTM (D-2116 or D-3307). MFR is related to melt viscosity (MV) by the relationship MV=53.15/MFR, when MFR is in units of g/10 min and MV is in units of $10^3$ Pa·s.

Raw dispersion particle size (RDPS) is measured by photon correlation spectroscopy.

Average particle size of powder particles is measured by laser light scattering on dry particles, (using the Microtrac 101 Laser Particle Counter, available from Leeds & Northrup, a division of Honeywell Corporation).

FEP dispersion: TFE/HFP copolymer resin dispersion in water with a solids content of from 28 to 32 weight percent and raw dispersion particle size (RDPS) of from 160 to 220 nanometers, the resin having a HFP content of from 10.3 to 13.2 weight percent, and a melt flow rate of from 2.95 to 13.3 g/10 min. The melting point of the resin is 507° F. (264° C.).

PFA dispersion: TFE/PPVE copolymer resin dispersion in water with a solids content of from 28 to 32 weight percent and raw dispersion particle size (RDPS) of from 150 to 245 nanometers, the resin having a PPVE content of from 2.9 to 3.6 weight percent and a melt flow rate of from 1.3 to 2.2 g/10 min. The melting point of the resin is 590° F. (310° C.). FEP powder (product code 532-8110 commercially available from the DuPont Company): TFE/HFP copolymer powder containing 10.3 to 13.2 weight percent HFP, a particle size in the range of 26.3 to 46.6 micrometers and a melt flow rate of 2.95-13.3 g/10 min, bulk density 48 to 72 g/100 cc. The melting point of the resin is 507° F. (264° C.).

PFA powder (type 350, product code 532-7410 commercially available from the DuPont Company): TFE/PPVE fluoropolymer powder containing 2.9 to 3.6 weight percent PPVE, a particle size in the range of 28.5 to 0.9 microns and a melt flow rate of 1.3 to 2.2 g/10 min, bulk density 56 to 87 g/100 cc. The melting point of the resin is 590° F. (310° C.).

Non-Melt Processible Binders

Polyamideimide (PAI) commercially available as TORLON AI-10 from Solvay Advanced Polymers.

Liquid Crystal Polymer (LCP) commercially available as XYDAR SRT-400 from Solvay Advanced Polymers.

Melt Processible Binders

Polyphenylene sulfide (PPS) commercially available as Ryton PR11-10 from Chevron Phillips Chemical Company.

Polyethylene sulfone (PES) commercially available as Sumika Excel PES 4100 mp from Sumitomo Chemical.

Polyetheretherketone (PEEK) commercially available as 150 PF grade from Victrex.

Other Components

Mica commercially available as grades of Afflair from EMD Chemicals. Silwet L-77 surfactant commercially available from GE Silicones. Black pigment commercially available as C.I. pigment black 28 from Engelhard Corporation.

Example 1

FEP/PAI Primer Powder

FEP/PAI primer powder was prepared using spray drying. Deionized water, surfactant (Silwet L-77), FEP and PAI were used. An APV pilot size spray dryer is turned on and preheated to 300° C. inlet air temperature and DI water is fed to the sprayer to maintain an outlet temperature of 115° C. The feed to the spray dryer is changed from DI water to the FEP mixture. Pump speed for the mixture is adjusted to keep the outlet temperature of the sprayer at 115° C. In the spray dryer the water is evaporated in the hot air stream and the resulting powder is collected through a cyclone separator.

Blended primer powder of FEP/PAI is applied by powder coating onto a grit blasted stainless steel panel as prepared above. The panel is placed into a 725° F. (385° C.) oven and baked for 30 minutes to form the primer layer. PFA overcoat powder, DuPont 532-5310, is electrostatically applied on top of the primer layer to form the overcoat layer. The panel is placed into a 680° F. (360° C.) oven and baked for 30 minutes to form the overcoat layer. Final coating thickness is in a range of about 100 to 145 micrometers having a primer thickness of about 50 to 70 micrometers and an overcoat thickness of about 50-75 micrometers. The adhesive strength of the bond of the coating to the substrate is tested using the peel test described above and results are presented in Table 1.

TABLE 1

FEP/PAI Primer Layer

| Sample | % FEP | % PAI | Center Peel | Primer Layer thickness (μm) |
|---|---|---|---|---|
| 1 | 15 | 85 | — | 50 |
| 2 | 30 | 70 | — | 50 |
| 3 | 35 | 65 | 1 | 55 |
| 4 | 40 | 60 | 4 | 60 |
| 5 | 50 | 50 | 4 | 70 |
| 6 | 60 | 40 | 4 | 50 |
| 7 | 65 | 35 | 4 | 52 |
| 8 | 70 | 30 | 4 | 55 |
| 9 | 75 | 25 | 1 | 50 |
| 10 | 80 | 20 | 1 | 50 |
| 11 | 85 | 15 | 1.5 | 50 |
| 12 | 90 | 10 | 1.5 | 55 |
| 13 | 95 | 5 | 1 | 55 |

For PAI loadings of 70 weight percent and higher, the coating peels off after baking the overcoat. For PAI loadings of less than 70 weight percent, the baked coating resists peeling prior to boiling. After the panel is placed in boiling water for 24 hours, the coating remains excellent for PAI loadings in the range of 30 to 60 weight percent. Therefore, testing shows evidence of a strong, durable bond between the coating and the stainless steel substrate.

Example 2

FEP/PAI/PPS Primer Powder

FEP/PAI/PPS primer powder was prepared using spray drying as described for FEP/PAI powder in Example 1.

As in Example 1, the blended primer powder of FEP/PAI/PPS is applied by powder coating onto a grit blasted stainless steel panel as prepared above. The panel is placed into a 725° F. (385° C.) oven and baked for 30 minutes to form the primer layer before applying the PFA overcoat powder. The panel is placed into a 680° F. (360° C.) oven and baked for 30 minutes to form the overcoat layer. Final coating thickness is in a range of about 100 to 150 micrometers having a primer thickness of about 45 to 75 micrometers and an overcoat thickness of about 50 to 75 micrometers. The adhesive strength of the bond of the coating to the substrate is tested using the peel test described above and results are presented in Table 2.

TABLE 2

FEP/PAI/PPS Primer Powder

| Sample | % FEP | % PAI | % PPS | Center Peel | Primer Layer thickness (μm) |
|---|---|---|---|---|---|
| 14 | 20 | 40 | 40 | 1 | 75 |
| 15 | 35 | 10 | 55 | 3 | 70 |
| 16 | 35 | 33 | 32 | 4 | 75 |
| 17 | 35 | 55 | 10 | 4 | 60 |
| 18 | 50 | 10 | 40 | 3 | 60 |
| 19 | 50 | 25 | 25 | 4 | 60 |
| 20 | 50 | 40 | 10 | 2 | 50 |
| 21 | 65 | 10 | 25 | 2 | 55 |
| 22 | 65 | 18 | 17 | 1 | 50 |
| 23 | 65 | 25 | 10 | 3.5 | 50 |
| 24 | 80 | 5 | 15 | 1.5 | 50 |
| 25 | 80 | 10 | 10 | 1 | 45 |
| 26 | 80 | 15 | 5 | 1 | 45 |

All of the FEP/PAI/PPS coatings resist peeling prior to boiling. After the panel is placed in boiling water for 24 hours, the coating remains excellent for a broad range of coating compositions. Therefore, testing shows evidence of a strong, durable bond between the coating and the stainless steel substrate.

Note that not all of the activities described above in the general description or the examples are required, that a portion of a specific activity may not be required, and one or more that further activities may be performed in addition to those described. Still further, the order in which activities are listed are not necessarily the order in which they are performed. After reading this specification, skilled artisans will be capable of determining what activities can be used for their specific needs or desires.

In the foregoing specification, the invention has been described with reference to specific embodiments. However, one of ordinary skill in the art appreciates that one or more modifications or one or more other changes can be made without departing from the scope of the invention as set forth in the claims below. Accordingly, the specification and figures are to be regarded in an illustrative rather than a restrictive sense and any and all such modifications and other changes are intended to be included within the scope of invention.

Any one or more benefits, one or more other advantages, one or more solutions to one or more, problems, or any combination thereof has been described above with regard to one or more specific embodiments. However, the benefit(s), advantage(s), solution(s) to problem(s), or any element(s) that may cause any benefit, advantage, or solution to occur or become more pronounced is not to be construed as a critical, required, or essential feature or element of any or all the claims.

It is to be appreciated that certain features of the invention which are, for clarity, described above and below in the context of separate embodiments, may also be provided in combination in a single embodiment. Conversely, various features of the invention that are, for brevity, described in the context of a single embodiment, may also be provided separately or in any sub-combination. Further, reference to values stated in ranges include each and every value within that range.

What is claimed is:

1. A process for forming a release surface on a substrate, the process comprising:

applying a primer powder on the substrate to form a primer layer, wherein the primer powder comprises a tetrafluoroethylene/perfluoroolefin copolymer and a non-melt processible binder, applying an overcoat powder on the primer layer to form an overcoat layer, wherein the overcoat powder comprises a tetrafluoroethylene/perfluoro(alkyl vinyl ether) copolymer, and baking the substrate after applying both the primer powder and the overcoat powder.

2. The process of claim 1, wherein the non-melt processible binder comprises polyamideimide, polybenzimidazole, polyimide, a liquid crystal polymer, or any combination thereof.

3. The process of claim 2, wherein the non-melt processible binder comprises polyamideimide.

4. The process of claim 1, wherein the primer powder comprises 35 to 90 weight percent of the tetrafluoroethylene/perfluoroolefin copolymer and 10 to 65 weight percent of the non-melt processible binder, based on a combined weight of the tetrafluoroethylene/perfluoroolefin copolymer and the non-melt processible binder.

5. The process of claim 1, wherein the perfluoroolefin comprises hexafluoropropylene.

6. The process of claim 1, wherein the perfluoro(alkyl vinyl ether) comprises perfluoro(propyl vinyl ether).

7. The process of claim 1, wherein the primer powder further comprises a melt processible binder.

8. The process of claim 7, wherein the melt processible binder includes polyether sulfone, polyphenylene sulfide, polyaryleneetherketone, or any combination thereof.

9. The process of claim 7, wherein the primer powder comprises 10 to 55 weight percent of the melt processible binder, based on a combined weight of the tetrafluoroethylene/perfluoroolefin copolymer, the non-melt processible binder, and the melt processible binder.

10. The process of claim 1, wherein the primer powder further comprises an inorganic filler.

11. The process of claim 10, wherein the inorganic filler includes mica flake, silicon carbide, carbon black, barium sulfate, ultramarine blue, mixed metal oxide pigment, aluminum oxide, or any combination thereof.

12. The process of claim 11, wherein the inorganic filler comprises mica flake and barium sulfate.

13. The process of claim 10, wherein the primer powder comprises 10 to 20 weight percent of the inorganic filler based on a combined weight of the tetrafluoroethylene/perfluoroolefin copolymer, the non-melt processible binder, and the inorganic filler.

14. The process of claim 1, wherein applying the primer powder comprises electrostatic spraying or hot flocking.

15. The process of claim 1, wherein applying the overcoat powder comprises electrostatic spraying or hot flocking.

16. The process of claim 1, wherein the substrate includes metal, ceramic, plastic, glass, or any combination thereof.

17. The process of claim 16, wherein the metal includes steel, high-carbon steel, stainless steel, aluminized steel, aluminum, or any combination thereof.

18. The process of claim 1, wherein the substrate is at an ambient temperature when applying the primer powder, applying the overcoat powder, or both.

19. The process of claim 1, further comprising baking the substrate after applying the primer powder and before applying the overcoat powder.

20. The process of claim 1, wherein a thickness of the primer layer is less than 100 micrometers and a thickness of the overcoat layer is less than 650 micrometers.

* * * * *